US010105985B2

(12) United States Patent
Batzer et al.

(10) Patent No.: US 10,105,985 B2
(45) Date of Patent: Oct. 23, 2018

(54) METHOD FOR ADJUSTING AT LEAST ONE MEANS OF AN INSERTING APPARATUS AND INSERTING APPARATUS

(71) Applicant: BOEWE SYSTEC GmbH, Augsburg (DE)

(72) Inventors: Josef Batzer, Leitershofen (DE); Thomas Huber, Stadtbergen (DE); Reinhard Seiler, Aindling (DE); Helmut Foerg, Grossaitingen (DE)

(73) Assignee: BOEWE SYSTEC GMBH, Augsburg (DE)

( * ) Notice: Subject to any disclaimer, the term of this patent is extended or adjusted under 35 U.S.C. 154(b) by 1341 days.

(21) Appl. No.: 13/873,592

(22) Filed: Apr. 30, 2013

(65) Prior Publication Data

US 2013/0291490 A1 Nov. 7, 2013

(30) Foreign Application Priority Data

May 2, 2012 (DE) ..... 10 2012 207 286

(51) Int. Cl.
*B43M 3/04* (2006.01)

(52) U.S. Cl.
CPC ..... *B43M 3/045* (2013.01)

(58) Field of Classification Search
CPC . B43M 3/00; B65H 7/00; B65H 43/00; B65H 2301/13; B65H 2301/1422; B65H 2511/10
USPC ..... 53/569, 284.3; 271/2
See application file for complete search history.

(56) References Cited

U.S. PATENT DOCUMENTS

| | | | | |
|---|---|---|---|---|
| 4,817,368 | A * | 4/1989 | DePasquale | B43M 5/042 271/119 |
| 5,130,558 | A | 7/1992 | Orsinger et al. | |
| 5,967,504 | A | 10/1999 | Yankloski | |
| 6,230,076 | B1 * | 5/2001 | Miller | B43M 7/02 53/381.6 |
| 6,293,076 | B1 | 9/2001 | Miller et al. | |
| 6,903,359 | B2 | 6/2005 | Miller et al. | |
| 7,398,635 | B2 * | 7/2008 | Fairweather | B43M 3/045 53/284.3 |

(Continued)

FOREIGN PATENT DOCUMENTS

| | | |
|---|---|---|
| DE | 195 19 607 A1 | 12/1996 |
| DE | 101 36 870 A1 | 2/2003 |

(Continued)

OTHER PUBLICATIONS

Official Communication issued in corresponding European Patent Application No. 13165782.7, dated Jul. 3, 2013.

*Primary Examiner* — Andrew M Tecco
*Assistant Examiner* — Praachi M Pathak
(74) *Attorney, Agent, or Firm* — Keating & Bennett, LLP

(57) ABSTRACT

A method for adjusting at least one means of an inserting apparatus adjusted for processing envelopes according to at least one predetermined dimension of the envelope is described. A plurality of envelopes is measured, while the envelopes are moved to obtain at least one predetermined dimension of the envelope. Depending on a comparison of the obtained dimension with the adjusted dimension and/or with one or several previously obtained dimensions, at least one means of the inserting apparatus is adjusted for processing the envelopes.

12 Claims, 5 Drawing Sheets

(56) References Cited

U.S. PATENT DOCUMENTS

| | | | | |
|---|---|---|---|---|
| 7,896,335 | B2 | 3/2011 | Stemmle | |
| 2004/0080099 | A1 | 4/2004 | Janatka et al. | |
| 2004/0255738 | A1 | 12/2004 | Benjaminsson | |
| 2006/0033262 | A1* | 2/2006 | Stemmle ..... | B65H 9/04<br>271/258.01 |

FOREIGN PATENT DOCUMENTS

| | | | |
|---|---|---|---|
| DE | 600 11 360 | T2 | 6/2005 |
| DE | 602 11 376 | T2 | 6/2007 |
| EP | 1 939 011 | A1 | 7/2008 |
| EP | 1 942 464 | A1 | 7/2008 |
| WO | 02/096670 | A1 | 12/2002 |
| WO | 2011/138440 | A2 | 11/2011 |

* cited by examiner

METHOD FOR ADJUSTING AT LEAST ONE MEANS OF AN INSERTING APPARATUS AND INSERTING APPARATUS

CROSS-REFERENCE TO RELATED APPLICATIONS

This application claims priority from German Patent Application No. 102012207286.1, which was filed on May 2, 2012, and is incorporated herein in its entirety by reference.

BACKGROUND OF THE INVENTION

The present invention relates to a method for adjusting at least one means of an inserting apparatus as well as an inserting apparatus, such that the inserting apparatus is adjusted for processing envelopes according to at least one predetermined dimension of the envelope.

Several approaches for inserting are known, wherein, according to a first approach, the envelope is stopped during inserting. The products to be inserted are introduced into the stopped envelope. According to another approach, both the envelope and the products to be inserted are moved during the inserting process, wherein the product and the envelope essentially move along the same transport direction. The envelope and the products to be inserted are moved towards each other during the inserting process, e.g. at an angle, as it is described, for example in WO 2002/096670 A1 In other inserters, it is intended to move the products to be inserted and the envelopes together along the same transport direction in an overlapping manner but at different speeds, wherein the envelope is moved slower than the product to be inserted, so that the products are introduced into the envelope due to the speed difference, as it is described, for example, in WO 2011/138440 A1.

Inserters operating, e.g., according to the above described approaches include an envelope feed and an inserting area, each comprising different means for operating on an envelope or a product to be inserted. The inserters are implemented to process envelopes having different dimensions in different jobs. Prior to the start of job processing, the inserters are adjusted to the size of the envelopes to be processed to ensure correct and optimal processing of products and envelopes. In the envelope feed, for example, the envelope withdrawing unit and a possibly provided feeding path is adjusted such that an envelope that is withdrawn is applied to the input of the inserting area with a predetermined orientation, for example such that the envelope is applied centrally in the inserting area with respect to a width of the transport area. Alternatively or additionally, different elements can be adjusted in the inserting area to operate optimally on the provided envelope, for example the position of filling aids moving into the envelope, the position of transport elements moving the envelope through the inserting area, elements for keeping the envelope open, for example a claw moving at least partly together with the envelope that holds a first side of the envelope separate from a second side of the envelope, the position of a blow means for providing blow air for initially opening the envelope, the position of sealing elements, for example wetting units and sealing rollers subsequent to the inserting path. Further, within the inserting area, elements of the product feed can be adjusted such that a product is introduced into the centrally provided envelope, wherein it can be intended, in the case of moving products and moving envelopes, to adjust, apart from the position of the spaced elements also a speed at which the same are moved, depending on a dimension and/or orientation of the envelope to ensure optimum processing, i.e. processing generating at least one predetermined number of inserted products during a predetermined time period.

As already mentioned, the adjustment of the individual elements of the means is performed depending on a dimension or depending on several dimensions of the envelopes to be processed, for example depending on a width of the envelope, a length of the envelope, a dimension of the envelope flap, a depth of the envelope opening or mouth and/or distance of an envelope window from an edge of the envelope body or the envelope flap. For this, an envelope is measured prior to the start of processing the job to obtain the respective dimensions and to adjust the inserting apparatus accordingly depending on the received measurement results.

In the prior art, several approaches are known to detect dimensions of the products or envelopes to be processed in a paper handling plant, for example in an inserter, wherein in this regard reference is made to DE 101 36 870 A1, DE 195 19 607, U.S. Pat. No. 6,293,076 B1, U.S. Pat. No. 5,967,504 and U.S. Pat. No. 7,896,335. These publications describe approaches for measuring the products/envelopes to be processed prior to their processing to adjust the inserter prior to the start of processing a job according to the received dimension.

The envelopes are provided by envelope manufacturers, wherein the provided envelopes comprise dimensions that can vary due to manufacturing tolerances, such that the envelopes from different envelope batches may, for example, have different envelope widths, lengths or the same, which might still be within the tolerances stated by the manufacturer and can still be processed by the inserting plant with the initial adjustment, however, these variations of dimensions have the effect that processing the envelopes is no longer at an optimum, in particular for example when a deviation reaches a maximum tolerance.

This problem will be discussed in more detail below based on FIG. 1, wherein FIGS. 1(*a*) to 1(*d*) illustrate different situations where the different dimensions of an envelope change. The upper regions of the respective figures show a first envelope $E_1$, whose dimensions have been measured at the beginning of the job for an adjustment of the inserter, and the bottom regions each show envelopes $E_2$ whose dimensions differ from the initial dimensions.

FIG. 1(*a*) shows a first envelope $E_1$ having a first width $B_1$. The inserter or the inserting apparatus has been adjusted such that the envelope $E_1$ is arranged centrally with respect to a transport path within the inserting area (see dotted line Z). The envelope $E_1$ comprises an envelope body $K_1$, an envelope flap $F_1$ and an envelope opening $M_1$. For filling the envelope with a product not illustrated in FIG. 1(*a*), a filling aid having two filling elements 100*a*, 100*b* is provided, which are introduced into the envelope body $K_1$ and serve to guide a product to be introduced into the envelope $A_1$, such that same does not come into contact with the lateral edges $R_1$ and $R_2$ of the envelope $E_1$. This ensures unobstructed filling of the envelope. The filling elements 100*a*, 100*b* are provided to support filling of the envelope, transport of the envelope is not to be performed, such that the filling elements are arranged spaced apart from edges $R_1$, $R_2$. The arrangement of the filling elements 100*a*, 100*b* illustrated in FIG. 1(*a*) with respect to the envelope $E_1$ allows optimum operation of the inserting apparatus. If a dimension of the envelope changes, for example a width, its optimum processing might no longer be ensured. The envelope $E_1$ has a width $B_1$ and is arranged centrally with respect to this width (see correspondence of dotted lines M and Z). If an envelope $E_2$ is obtained comprising a width $B_2$, which is smaller than a width $B_1$, but still lies, e.g., within the tolerance stated by the manufacturer, this has the effect that due to the adjustments in the envelope feed, feeding the envelope $E_2$ is performed the same way as feeding the envelope $E_1$, such that the envelope $E_2$ is no longer oriented to the center of the transport with its center seen in a width direction (see deviation of dotted lines M and Z) as schematically shown in the bottom region of FIG. 1(*a*). This has the effect that the filling elements 100*a*, 100*b* can still be introduced into the envelope $E_2$, but the filling element 100*a* contacts the edge $R_1$ of the envelope $E_2$, which can cause problems, for example damages of the envelope in the area of the edge $R_1$ or problems when withdrawing the filled envelope or the same, such that optimum inserting is no longer ensured.

FIG. 1(*b*) shows a further problem which can result when the envelope width changes. FIG. 1(*b*) shows a similar situation as FIG. 1(*a*), namely two envelopes $E_1$ and $E_2$ having different widths. For the envelope $E_1$, its central line M coincides with the center of the transport path in the inserter, and an envelope transport keeps the envelope $E_1$ centrally, as is shown by the arrow in the upper illustration in FIG. 1(*b*). If the width of the envelope changes, as it is the case for the envelope $E_2$, the central line M of the envelope $E_2$ is outside the transport path, such that respective envelope transport also grips off-center, such that the torques acting on the envelope might lead to a non-optimum transport of the envelope and to possible problems due to the different width dimensions.

Based on FIG. 1(*c*), a further problem is illustrated which can occur when processing envelopes of different dimensions. FIG. 1(*c*) shows a first envelope $E_1$ having an envelope opening $M_1$ whose depth has a dimension $L_1$ in transport direction. Schematically, a claw 102 is shown engaging the back of the envelope $E_1$, and keeps the same separated from an underlying front of the envelope $E_1$, such that the envelope $E_1$ is kept open during an inserting process. If, for example due to tolerances, a size of the envelope depth of the opening changes, as shown in the bottom region of FIG. 1(*c*), a situation can occur where the claw 102 no longer engages the back of the envelope, as shown in FIG. 1(*c*), namely when the depth of the envelope opening of the envelope $E_2$ is larger than the depth of the envelope opening of envelope $E_1$.

Based on FIG. 1(*d*), a further problem is illustrated that can occur when processing envelopes of different dimensions, in particular with envelopes whose length changes within the tolerance range. FIG. 1(*d*) shows, in the upper region, the envelope $E_1$ of length $L_1$ in transport direction, wherein a product $G_1$ introduced into the envelope $E_1$ is illustrated in a shaded manner, which is moved by product transport elements 104*a*, 104*b* into the envelope $E_1$. The envelope transport elements 104*a* and 104*b* are adjusted such that the same are moved to effect complete introduction of the product $G_1$ into the envelope $E_1$, which is performed depending on the length $L_1$ of the envelope $E_1$. If the length $L_1$ changes, for example in a way as is shown in FIG. 1(*d*), such that the length $L_2$ of the envelope $E_2$ is smaller than the length $L_1$ of the envelope $E_1$, this will have the effect that the transport elements 104*a*, 104*b* no longer introduce a product $G_2$ completely into the envelope $E_2$, such that an area X projects from the envelope opening, which can result in problems during further inserting, in particular when sealing the envelope.

The problems described based on FIG. 1 occur since the inserting apparatus had been adjusted at the beginning of a job to process the envelope $E_1$ of the respective dimensions, but the dimensions of the envelope can change in the above described manner due to manufacturing tolerances, such that the operation of the inserting plant might be interfered with, but is at least no longer at an optimum, i.e. compared to processing envelopes of dimensions according to the envelope $E_1$, with changing dimensions, the number of envelopes to be processable during a predetermined time at least be reduced, since due to the non-optimum operation either the speed has to be changed or disruptions due to errors increase.

In the context of paper processing plants, approaches are known for reacting to changes of supplements or a paper web. EP 1 942 464 B1 describes a method where readjustment of a supplement feed to a gathering web is performed due to measurement values. U.S. Pat. No. 5,130,558 A describes a method where products are measured before the same are inserted. DE 602 11 376 T2 describes measurement of a moving paper web, such that variations in the paper web width can be dealt with. Inserters and changes of dimensions of the envelope are not discussed.

As far as the approaches described in the above stated publications relate to dimensions of envelopes, it has to be stated that the same merely relate to the dimension of an envelope prior to turning-on the inserting apparatus to perform adjustment of the inserting plant depending on the dimension of the envelope. The above described problems occurring due to the changes of dimensions of the envelope due to manufacturing tolerances of the envelope are not mentioned. Further, measuring the envelope is performed during standstill of the envelope.

SUMMARY

According to an embodiment, a method for adjusting at least one means of an inserting apparatus adjusted for processing envelopes according to at least one predetermined dimension of the envelope may have the steps of: measuring a number of envelopes while the envelopes are moved to obtain the at least one predetermined dimension of the envelope; depending on a comparison of the obtained dimension with the adjusted dimension and/or with one or several previously obtained dimensions, adjusting the at least one means of the inserting apparatus for processing the envelopes.

According to another embodiment, an inserting apparatus having at least one means adjusted for processing envelopes according to at least one predetermined dimension of the envelope may have: a measurement path that is configured to move the envelopes; a sensor assembly configured to measure a plurality of envelopes to be transported along the measurement path, while the envelopes are moved to obtain the at least one predetermined dimension of the envelope; and at least one control configured to generate, depending on a comparison of the obtained dimension with the adjusted dimension and/or with one or several previously obtained dimensions, a control signal for the at least one means to effect adjustment of the at least one means of the inserting apparatus for processing the envelopes.

According to embodiments, a plurality of envelopes is provided to the inserting apparatus, wherein only part of the plurality of the provided envelopes is measured. Between two measured envelopes, a number of envelopes cannot be measured. The number of non-measured envelopes can be fixed or variable.

According to embodiments, the means of the inserting apparatus can comprise one or several elements that are configured to operate on the envelope, wherein adjusting the means comprises adjusting the element to a predetermined position and/or adjusting a position of the elements relative to one another, wherein the position is selected in dependence on the comparison.

According to embodiments, adjusting the means can comprise adjusting the speed at which the envelopes or a product to be inserted are transported, wherein the speed is selected depending on the comparison.

According to embodiments, the envelopes can have a predetermined orientation in the inserting apparatus.

According to embodiments, the means can be adjusted to maintain the predetermined orientation of the envelopes in the inserting apparatus. The envelope can be oriented centrally with respect to a width of a transport of the inserting apparatus. A tendency can be detected from the obtained dimensions, whether the at least one predetermined dimension of the envelope increases or decreases, and when detecting a tendency, the means can be adjusted to maintain the orientation of the envelopes to the predetermined position. The envelope can be oriented centrally with respect to a width of the means, and when detecting a deviation of the obtained dimension by a predetermined amount in one direction, the means can be adjusted to move the envelope by half of the deviation into the opposite direction such that its central orientation is maintained.

According to embodiments, the inserting apparatus can comprise an inserting area and/or an envelope feed, wherein the at least one means of the inserting apparatus comprises, in the inserting area, one or several filling aids, one or several envelope feeds, an envelope opener, an envelope sealer and/or a product transport and wherein the at least one means of the inserting apparatus in the envelope feed comprises an envelope withdrawing unit and/or an orientation path for the envelopes.

According to embodiments, a tendency can be detected from the obtained dimensions, whether the at least one predetermined dimension of the envelope increases or decreases, wherein detecting the tendency comprises:

- determining a number of successive envelopes for which the obtained dimensions continuously increase or decrease; and
- detecting the tendency when the predetermined number reaches a predetermined threshold.

According to embodiments, the envelope can be measured by optical signals.

According to embodiments, the predetermined dimension of the envelope can comprise at least one of the following:

- a width of the envelope perpendicular to a transport direction,
- a length of the envelope along the transport direction,
- a dimension of the envelope flap,
- a depth of the envelope opening, and
- a distance of the envelope window from an edge of the envelope body or the envelope flap.

According to embodiments, measuring the envelope during its movement can further comprise obtaining a further predetermined dimension of the envelope, and adjusting the means can further be based on a comparison of the obtained further dimension with a further adjusted dimension.

BRIEF DESCRIPTION OF THE DRAWINGS

Embodiments of the present invention will be detailed subsequently referring to the appended drawings, in which.

DETAILED DESCRIPTION OF THE INVENTION

In the following description of the embodiments, same or equal elements are provided with the same reference numbers and the mentioned elements are not described multiple times.

The inventive approach solves the above described problems in that during the operation of the inserting apparatus at least one means or unit of the same is adjusted to maintain optimum operation of the apparatus. According to the invention, it is intended to measure a plurality of envelopes while the same are moved, i.e. for example during feeding the envelopes from the envelope feeder to the inserting area of the inserting apparatus. Measuring the plurality of envelopes has the effect that at least one predetermined dimension of the envelope is obtained, for example a width dimension, a length dimension, a dimension of the envelope flap, a depth of the envelope opening or a distance of an envelope window from an envelope edge or from the envelope flap. According to embodiments, it can also be envisaged to obtain several dimensions.

The dimensions obtained in this way are compared to the initially set dimensions and/or to one or several previously obtained dimensions. Depending on this comparison, adjusting of at least one means of the inserting apparatus is performed, for example readjusting the elements of this means to maintain optimum operation of the inserting apparatus.

Figure 1A:
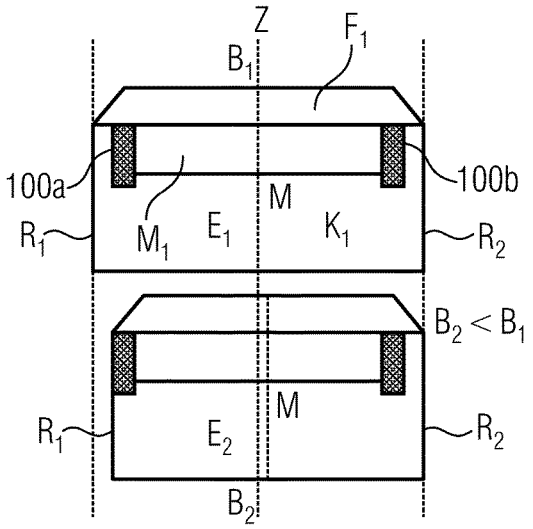
FIGS. 1(*a*)-1(*d*) are different situations where different dimensions of the envelope change.
Figure 1B:
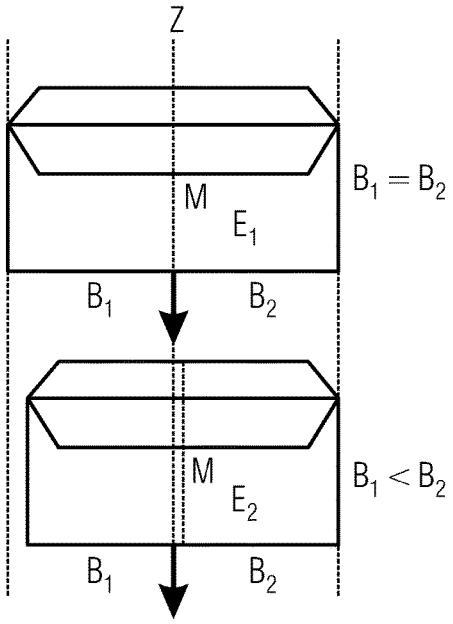
Figure 1C:
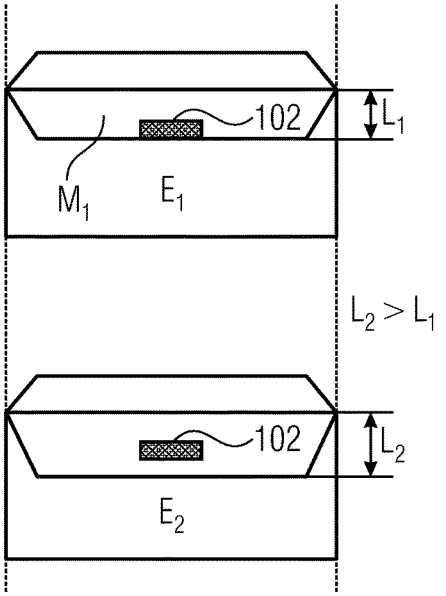
Figure 1D:
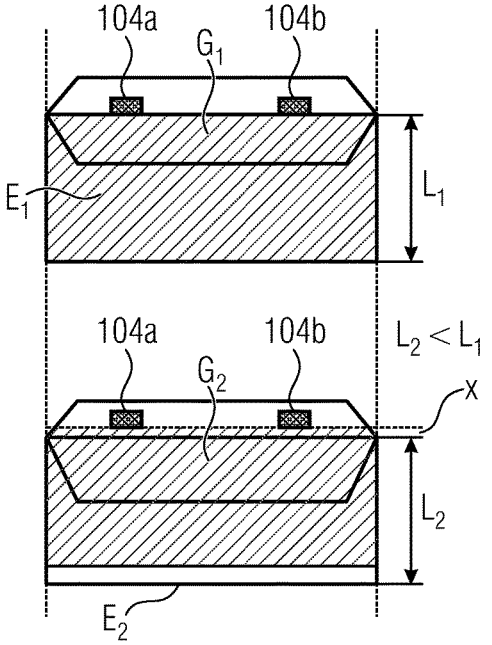
Figure 2:
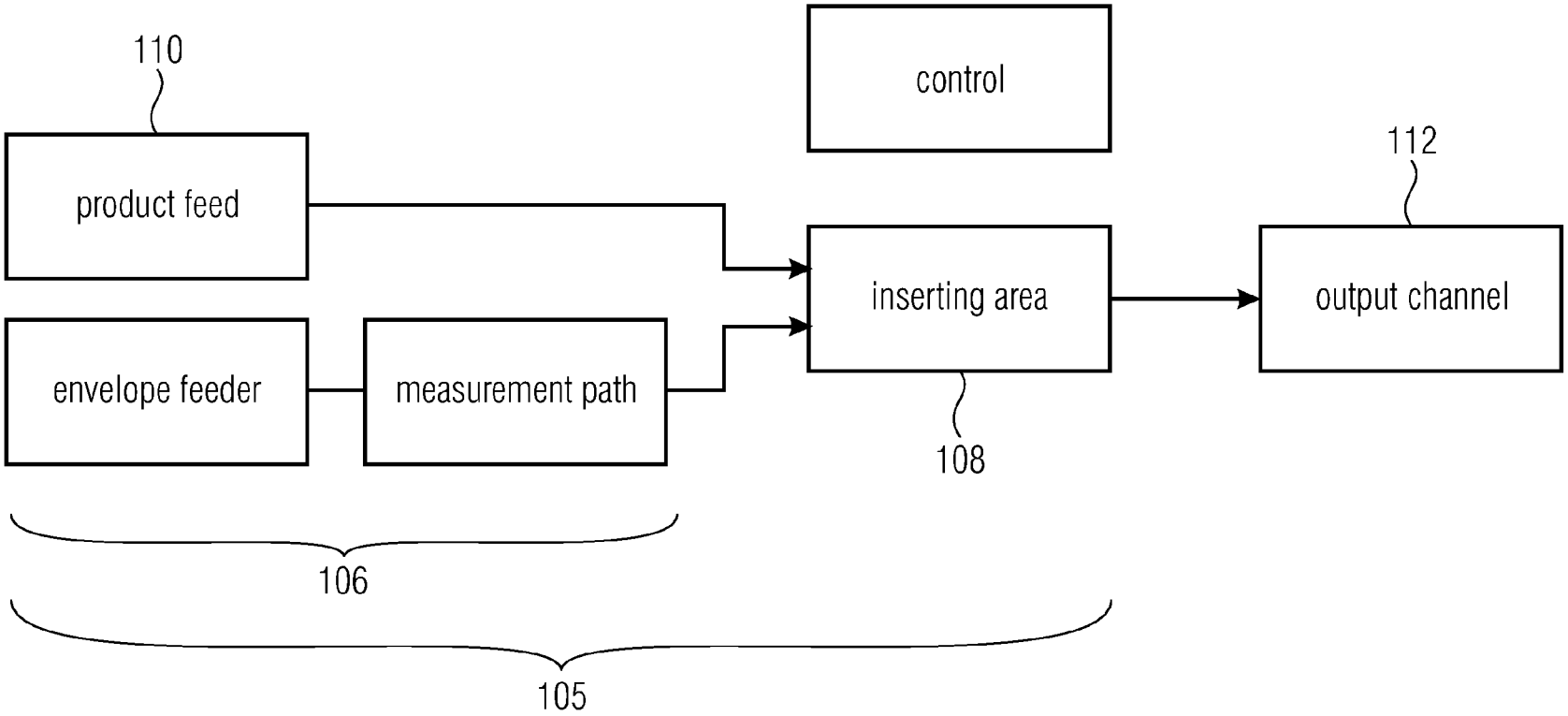
FIG. 2 is a schematic illustration of an inserting apparatus having an envelope feed and an inserting area.

FIG. 2 shows a schematic illustration of an inserting apparatus 105 comprising an envelope feed 106 and an inserting area 108. The envelope feed 106 comprises, for example, an envelope feeder, a measurement path and an orientation path (not shown in FIG. 2). In the envelope feeder, envelopes having the predetermined dimensions to which the inserting apparatus is adjusted are provided, withdrawn and provided to the inserting area 108 via the measurement path and the optionally provided orientation path. The measurement path is implemented to measure the withdrawn envelopes during a movement along the measurement path, wherein, in embodiments, the measurement path can also be part of the orientation path. According to embodiments, the inserting area comprises filling aids, envelope guides, envelope openers, envelope sealers as well as a product transport to insert the products fed to the inserting area 108 into the envelopes supplied or fed to the inserting area 108. FIG. 2 shows a paper processing plant comprising, in addition to the inserting apparatus 105 consisting of the envelope feed and inserting area, a product feed 110 for providing the products to be inserted, for example in the form of a gathering web with supplement feeders and the like, and an output channel 112 for processing the closed envelopes, for example for sorting the same, wherein the product feed 110 and the output channel 112 are independent means in addition to the inserting apparatus.

According to the invention, an envelope is measured along the measurement path to obtain one or several predetermined dimensions of the envelope. The inserting apparatus 105 was adjusted for the envelopes provided in the envelope feeder, and the measurement along the measurement path serves to detect deviations with respect to one or several predetermined dimensions of the envelope to allow, according to embodiments, resetting or readjustment of the inserting apparatus. More accurately, according to embodiments, it can be envisaged to adjust elements in the envelope feed 106 and/or in the inserting area 108, starting from the detected measurements measured along the measurement path, for example it can be envisaged to adjust the withdrawal from the envelope feeder in dependence on the detected dimension, or to adapt a possibly provided orientation path to ensure, at the input of the inserting area 108, the desired orientation of the envelope with respect to a transport means in the inserting area 108. In the inserting area, for example, the provided envelope transport, the filling aids or opening means for the envelope can be adjusted, adjustment of elements in the envelope sealer or in product transport can also be provided to ensure an optimum effect of the respective elements on the envelope or the product to maintain optimum operation of the inserting apparatus.

Detecting and processing dimensions and generating the necessitated control signals for the respective elements in the envelope feed 106 or in the inserting area 108 can be effected by one or several controls of the inserter (see FIG. 2) or by a central control of a paper-handling plant.

According to embodiments, it is envisaged to detect, by means of the detected measurement values, changes in the dimensions of the envelope, wherein not every successive envelope has to be measured, but it is sufficient, after detecting a dimension of a first envelope, to detect a renewed dimension again only after a predetermined number of further envelopes have passed the measurement path, for example if it is determined that new envelopes have been introduced into the envelope feeder, whose dimensions, due to manufacturing tolerances, might be different to those which have been withdrawn so far. This allows readjusting the inserting apparatus to maintain its optimum operating point.

Further, embodiments allow detecting a tendency where it is detected from a comparison of a plurality of obtained dimensions measured by the measurement path whether the respective dimension of the envelopes increases or decreases. For example, a number of successive envelopes, for which the obtained dimensions are continuously increasing or decreasing, can be determined, and a tendency is detected when the predetermined number reaches a predetermined threshold.

This will be explained exemplarily based on FIG. 1, where it can be seen in the case of FIG. 1(*a*) that the envelope $E_2$ has a smaller width $B_2$ than the previously transported envelopes $E_1$. According to the invention, the means of the inserting apparatus 105 are influenced, for example, an orientation path, which has the effect that the envelope $E_2$ is orientated such that its central line M coincides with the central line Z, so that the filling aids shown in FIG. 1(*a*) are arranged, also for the envelope $E_2$, similarly to the envelope $E_1$, with a distance from the edges $R_1$ and $R_2$ of the envelope $E_2$. Alternatively (if no change of the orientation path is desired or possible) or in inserting apparatuses comprising no orientation path, displacing the filling element 100*a*, 100*b* of the filling aid (in the figure towards the right) can be effected instead, for example by half of the distance by which the width $B_2$ of the envelope $E_2$ differs from the width $B_1$ of the envelope $E_1$, which has the same effect, namely that the filling element 100*a* no longer abuts on the edge $R_1$, but that both filling elements, similarly to the envelope $E_1$, have a distance (less than for envelope $E_1$) to the edges $R_1$, $R_2$ of the envelope $E_2$, whereby contact of one or several of the filling elements 100*a*, 100*b* with the edges is prevented.

In the case illustrated in FIG. 1(*b*), an orientation of the envelope $E_2$ can be tracked. Alternatively, the envelope transport can be displaced within the inserting area, so that the same engages at the center M of the envelope $E_2$.

In the cases shown in FIGS. 1(*c*) and (*d*), the speed of the claw 102 or the product transport element 104*a*, 104*b* can be changed, so that in the case of FIG. 1(*c*) the claw 102 is accelerated, for example when a larger envelope opening is determined, so that the same reaches the envelope opening edge also for envelope $E_2$, similarly to envelope $E_1$, and can separate the back of the envelope from the front. Accelerating the product transport elements 104*a*, 104*b* allows the product to be completely inserted, even with a slightly shorter envelope $E_2$.

Obviously, the above-described measures can be taken vice versa to compensate changes of the dimensions of the envelopes in another direction than the direction described in FIG. 1, for example with an increase of the width or reduction of the size of the envelope opening or an increase of the envelope length.

The measurement path is implemented to obtain the dimensions of the envelope, for example by optical sensors or ultrasonic sensors, for example a double sheet sensor for detecting the dimension of the envelope opening.

According to embodiments, it can be envisaged that an average from a plurality of measurements is obtained, for example based on 10 subsequent measurements, to compare the same with the adjusted values or one or several previously (earlier) obtained (and cached) averages, wherein adjustment of the means of the inserting apparatus is advantageously performed via several stages or linearly increasing or linearly decreasing to prevent large jumps.

Figure 3:
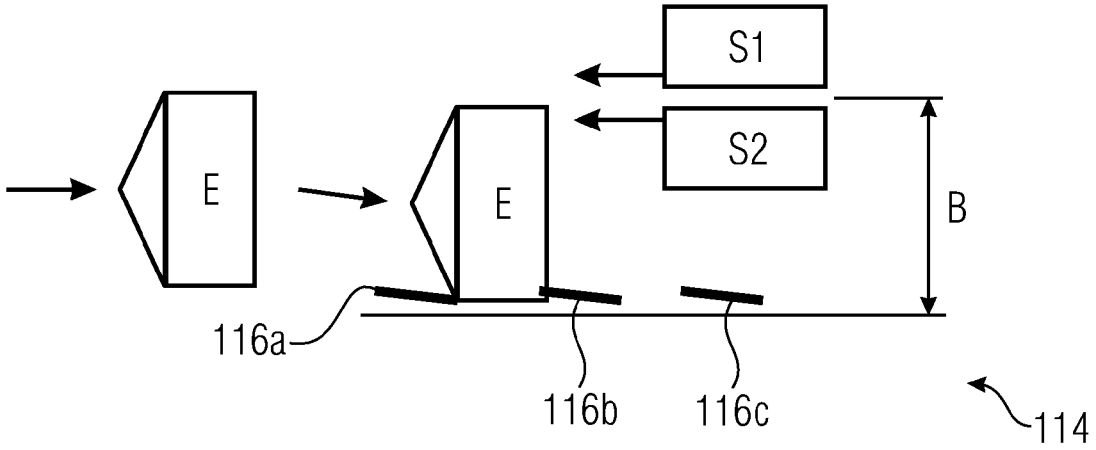
FIG. 3 is an example for an orientation path allowing regulation or tracking of an envelope transport within an inserting apparatus.

FIG. 3 shows an example of an orientation path allowing regulation or tracking of an envelope transport within the inserting apparatus. The orientation path comprises an adjustable stop 114, against which the envelopes E are moved, as is indicated by the schematically shown drives 116*a* to 116*c*. The stop 114 is adjusted in dependence on an envelope width B of the envelope E to be processed, such that the envelopes E are oriented centrally with respect to a subsequent means of the inserting apparatus at the end of the orientation path, for example centrally with respect to an envelope transport moving a feed of the envelope from the orientation path to the inserting area or centrally with respect to an input of the inserting area where the envelope is taken over by an envelope transport of the inserting area. Sensors S1 and S2 are arranged along the orientation path, which can, for example, be optical sensors in the form of light barriers. At the end of the orientation path, the central position of the envelope E is checked, which is indicated by the fact that one of the two light barriers S1 and S2 has to be occupied and the other one has to be free. In this case it is determined that a format width has been adjusted correctly. If no light barrier is occupied, the format is too large. If both light barriers are occupied, the format is too small. These light barriers are displaced center-symmetrically to the displacement axis of the orientation path. At the beginning of processing a job, the format width from the envelope withdrawal is used as the initial value, which is obtained by measuring this envelope when withdrawing the first envelope E of the new job, and the orientation path is adjusted accordingly, so that the envelope is arranged centrally with respect to the subsequent elements of the inserting apparatus. During operation, the envelope width of one or several of the subsequently withdrawn envelopes is measured, wherein either all envelopes are measured or only a predetermined number, for example every fifth, tenth, or hundredth envelope, so that when detecting a deviation or a situation where the envelopes are no longer arranged centrally, resetting or readjustment of the orientation takes place, for example by readjusting the adjustable stop 114, so that a central orientation of the envelope is ensured in this embodiment.

Based on FIG. 3, an example of a means of an inserting apparatus is described which can be operated on to compensate variations or changes of a dimension, in the described case the width of an envelope E, by readjusting the orientation path.

However, the present invention is not limited to such an implementation, but, as mentioned above, in other areas of the inserting apparatus it is also possible to operate on the elements cooperating with the envelopes/products to compensate a change of the envelope dimensions.

In the following, an example of a continuously operating inserter will be discussed based on FIG. 4, wherein during the inserting process, the envelope and the products to be inserted are moved continuously, wherein the products are moved faster than the envelope, so that introducing the products into the envelope is accomplished due to the speed excess. According to this inserting principle, neither the products nor the envelopes are stopped during the inserting process.

Figure 4:
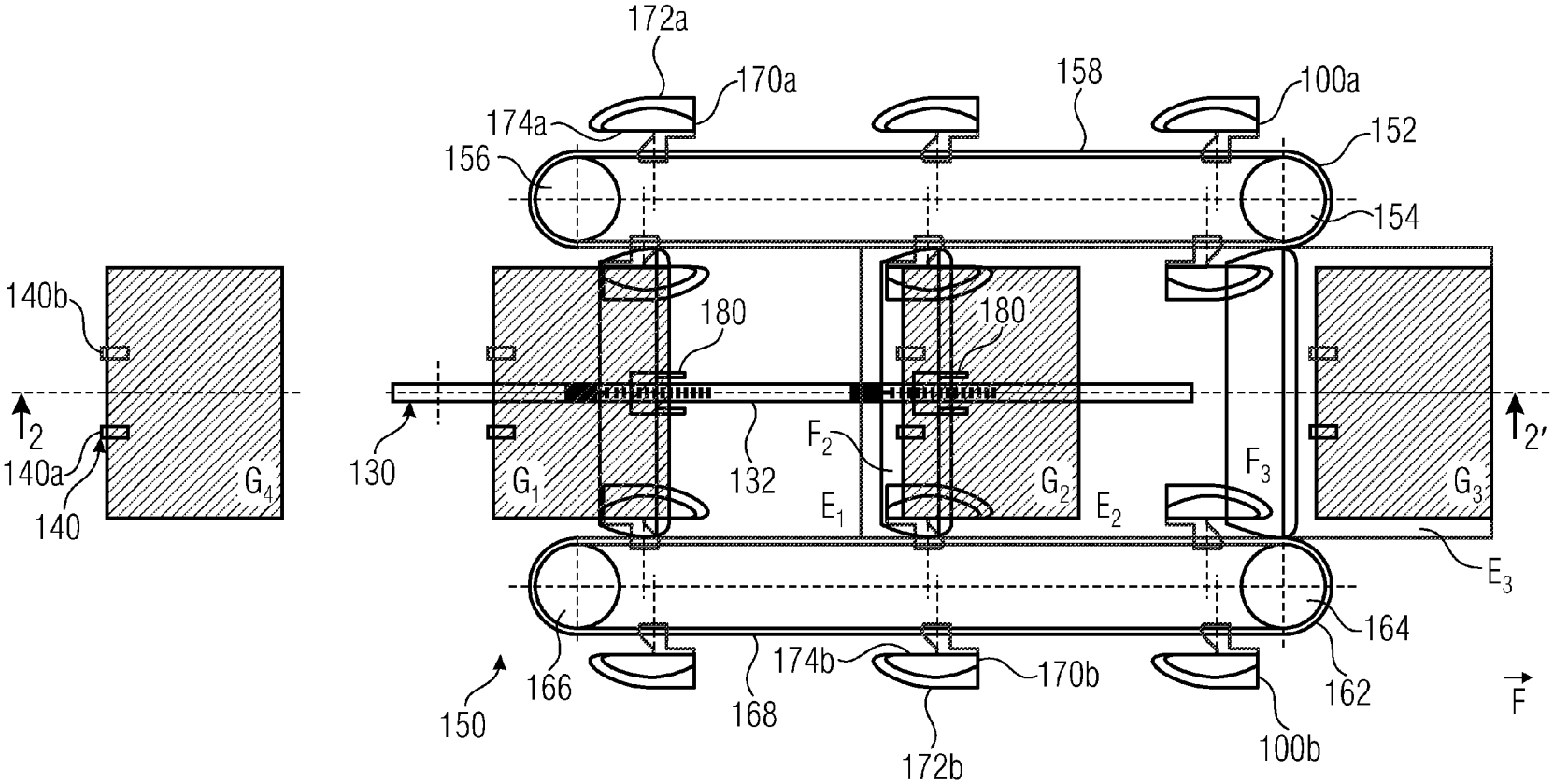
FIG. 4 is an example for a continuously operating inserter where the envelope and the products to be inserted are moved continuously during the inserting process.

FIG. 4 is a schematic illustration of such an inserter in a top view. The inserter comprises an envelope transport 130 having, according to embodiments, a suction belt 132. The envelope transport 300 moves the envelopes $E_1$ and $E_2$ along an inserting path starting, for example, at the position where the envelope $E_1$ and the product $G_1$ are initially arranged in an overlapping manner, and ending when the products are arranged completely within the envelope $E_1$. FIG. 1 shows a further envelope $E_3$ which has already left the inserting path and which includes the products $G_3$. Further, the products $G_4$ are illustrated which are moved from the left side in FIG. 1 in the direction of the inserter, for example by means of a product feed, to be then introduced into an envelope which is fed to the inserting area subsequent to envelope $E_1$. The envelope $E_1$ is at the beginning of the inserting path and the products $G_1$ have already passed the flap $F_1$, so that the leading edge of the product is inside the envelope $E_1$. Due to the different speeds at which the envelope and the products are moved, the products are introduced into the envelope along the inserting path. The product $G_2$ is already inside the envelope $E_2$ for the most part and the trailing edge of the product has already passed the edge of the flap $F_2$. The envelope $E_3$ is already filled, i.e. a leading edge of the product has already reached the bottom of the envelope.

The inserter further comprises a product transport 140 comprising the plurality of product transport elements 104*a*, 104*b*, which have been discussed above based on FIG. 1. According to embodiments, this can be shifting elements engaging products $G_1$ to $G_4$ to move these products at a speed that is higher than the speed at which the envelope transport 130 operates. The products and the envelopes are moved in the same transport direction F, and the openings of the envelopes are arranged perpendicularly or laterally to the transport direction F so that the movement of the envelopes and the products along the same direction F (in an overlapping manner) results in the insertion of the products into the envelopes. The product transport elements 104*a*, 104*b* are arranged with respect to the trailing edges of the product at positions symmetrically to the center of the product. The product transport 140 is longer than the envelope transport 100, wherein the product transport 140 can be provided to effect expelling of the filled envelopes from the inserting path.

Further, the inserter includes the filling aid 150 having a first conveyor 152 which again comprises a first driven roller 154 and a second roller 156, on which a chain or a belt 158 extends. A plurality of filling elements 100*a*, for example so-called filling fingers, are arranged along the chain 158 at predetermined positions. The first conveyor 152 is arranged such that the filling elements 100*a* are moved along the conveying direction F on one side of the conveyor, which opposes the envelope transport 100, and are moved in the opposite direction on the side facing away from the transport 130. This means that the filling elements 100*a* are moved along the inserting path and moved back from the end of the inserting path to the beginning of the same. The filling aid 150 further includes a second transport 162, further comprising again a driven roller 164, a further roller 166 and a chain or a belt 168 extending around the rollers. The filling elements 100*b* are arranged along the chain 168 to be movable similarly to the filling elements 100*a*. The filling elements 100*a*, 100*b* are provided to be inserted into the envelopes $E_1$ and $E_2$ at a predetermined distance. They serve to guide the product during filling, according to the presented embodiment, to prevent collisions of the products with the edges of the envelopes.

In the shown embodiment, the filling elements 100*a*, 100*b* are merely provided to effect guidance of the goods to be introduced; the transport of the envelope is performed by means of the envelope transport 130. In other embodiments, the inserter might not comprise any transport 130; instead the envelopes are moved along the inserting path by the filling elements 100*a*, 100*b*.

In the shown embodiment, the filling elements 100*a*, 100*b* have a bottom part 170*a*, 170*b*, a top part 172*a*, 172*b* and a vertical element 174*a*, 174*b* connecting the top and bottom parts of the filling elements 100*a*, 100*b*. The bottom and top elements can be movable with respect to each other, depending on the thickness of the products to be inserted.

The inserter further comprise several separating claws 180 engaging a trailing edge of the envelope opening to keep the envelope open along the filling path, i.e. to separate the two opposite sides, the front and the back of the envelope to prevent collisions between products and the upper side of the envelope.

Figure 5:
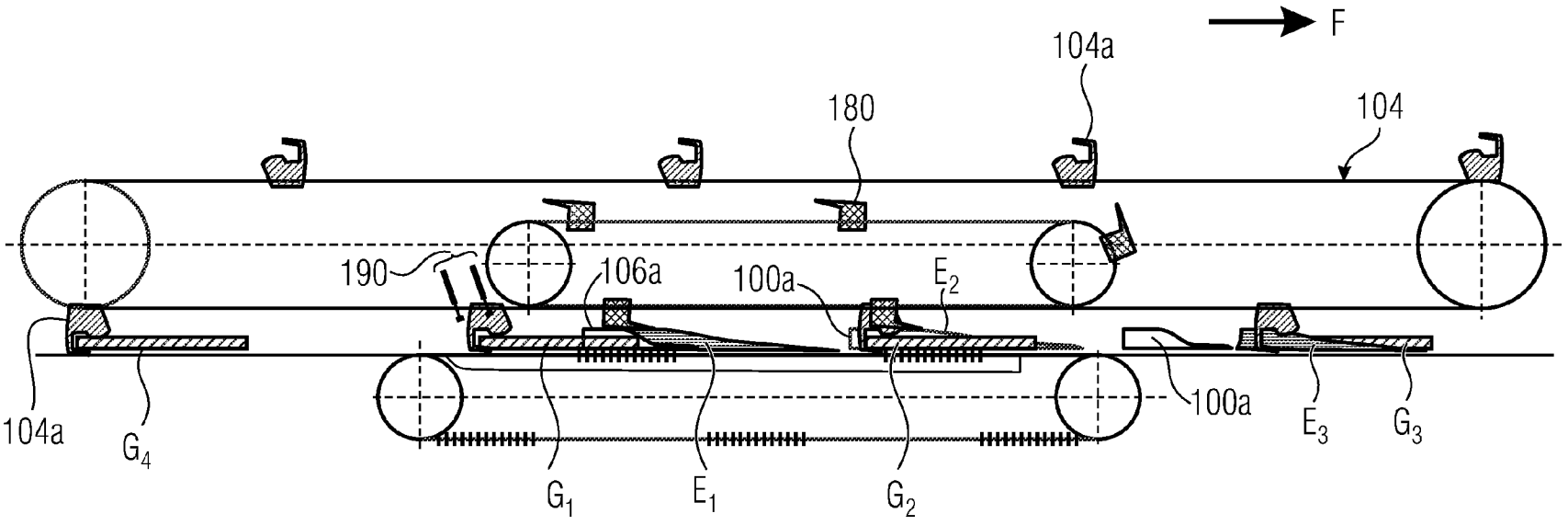
FIG. 5 is a lateral illustration of the assembly shown in FIG. 4 along the central line 2, 2' of the transport path through the inserting area in FIG. 4.

FIG. 5 shows a lateral illustration of the assembly shown in FIG. 4 along the central line 2, 2' of the transport path through the inserting area. FIG. 5 shows further details of the envelope transport, the product transport and a transport for the claws 180, each comprising belts extending around pairs of rollers which are spaced apart. Further, a pair of blowing nozzles 190 is shown, arranged at the beginning of the inserting path to direct blowing air in the direction of an envelope that has just been received in order to support opening of the envelope.

In the inserter shown based on FIGS. 4 and 5, the envelope feed can be arranged below the envelope transport 130. Along the envelope feed, the above-described orientation path can be provided which passes the envelopes to a feed transport with a desired orientation, which passes the orientated envelopes to the envelope transport 130. In such a case, the orientation path is readjusted to maintain the central orientation of the supplied envelopes.

In other embodiments, merely the measurement path can be provided in the envelope feed and instead of an orientation path, it can be envisaged to operate on the different elements in the inserting area or also on elements in the envelope feeder to compensate a deviation of the dimensions of the envelope due to manufacturing tolerances.

As has already been described above, for example the filling elements 100*a*, 100*b* can be adjusted to each other with respect to their distance from one another, wherein advantageously the entire assembly 150, or more accurately the belt drives 152, 162 on both sides of the envelope transport 130 are movable with respect to one another, to change the distance between the filling elements 100*a*, 100*b* when a deviation of the envelope width necessitating readjustment is detected. Further, it can be envisaged that the transport 130 is implemented to be displaceable transversally to the transport direction F to readjust the same, so that the same is aligned with the center of the transported envelope or fed envelope. If it is determined that a length of the envelopes deviates in the transport direction F, the product transport 140 can be accelerated or decelerated to ensure complete filling of the envelope with the product. If it is determined that an envelope opening comprises a dimension along the conveying direction F that deviates from the adjusted deviation by a predetermined amount, the drive of the claw 180 can be accelerated or decelerated to ensure that the claw engages the top of the envelope when taking over the envelope in the transport area, to keep the same open along the filling path. Further, it can be envisaged to modify a position of the blow air nozzle 190 along the conveying direction F, to ensure that the output blowing air reaches the envelope such that opening of the same is supported, in particular when the length of the envelope deviates from the adjusted length along the conveying direction F.

It should be noted that also a plurality of dimensions of the envelope can be detected in order to perform one or several of the above-stated operations in response to respective deviations.

Embodiments of the invention have been explained based on an inserting principle, as was discussed in FIGS. 4 and 5, but which are not limited to this inserting principle. Rather, the inventive approach can be applied to any type of inserting apparatus, i.e. also to inserting apparatuses operating in the start/stop operation, where an envelope has to be applied to the inserting position in a predetermined orientation at the time of inserting, which can, however, vary depending on deviations of the dimensions. Here, too, maintaining the desired orientation during deviations from the predetermined dimensions can be obtained in a manner similar to that discussed above, for example by operating on an envelope transport. The inventive approach can also be applied to inserting apparatuses moving the envelope and the product to be inserted towards each other.

While some aspects have been described in the context of an apparatus, it is obvious that these aspects also represent a description of the respective method, so that a block or a member of an apparatus can also be seen as a respective method step or as a feature of a method step. Analogously, aspects that have been described in the context of a method step or as a method step also represent a description of a respective block or details or features of a respective apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A method for adjusting at least one unit of an inserting apparatus adjusted for processing envelopes according to at least one predetermined dimension of a first envelope, comprising:

measuring a plurality of envelopes while the plurality of envelopes is moved to obtain the at least one predetermined dimension of the first envelope to provide an obtained dimension; and depending on a comparison of the obtained dimension with an adjusted dimension and/or with one or several previously obtained dimensions, adjusting the at least one unit of the inserting apparatus for processing the plurality of envelopes; wherein the plurality of envelopes is measured while the plurality of envelopes is fed from an envelope feeder to an inserting area of the inserting apparatus to insert a product into the first envelope.

2. The method according to claim 1, wherein only some of the plurality of envelopes is measured.

3. The method according to claim 1, wherein the at least one unit of the inserting apparatus comprises one or several elements that are configured to operate on the first envelope, wherein adjusting the at least one unit comprises adjusting the element to a predetermined position and/or adjusting a position of the elements relative to one another, wherein the position is selected depending on the comparison.

4. The method according to claim 1, wherein adjusting the at least one unit comprises adjusting a speed at which the plurality of envelopes or the product to be inserted are transported, wherein the speed is selected depending on the comparison.

5. The method according to claim 1, wherein the plurality of envelopes in the inserting apparatus comprise a predetermined orientation, and wherein the at least one unit is adjusted to maintain the predetermined orientation of the plurality of envelopes in the inserting apparatus.

6. The method according to claim 5, wherein the first envelope is orientated centrally with respect to a width of a transport of the inserting apparatus.

7. The method according to claim 5, wherein a tendency is detected from the obtained dimensions whether the at least one predetermined dimension of the first envelope increases or decreases, and wherein, when detecting the tendency, the at least one unit is adjusted to maintain an orientation of the first envelope at a predetermined position.

8. The method according to claim 1, wherein:

at least one unit of the inserting apparatus in the inserting area comprises one or several filling aids, one or several envelope guides, an envelope opener, an envelope sealer and/or a product transport, and at least one unit of the inserting apparatus in the envelope feeder comprises an envelope withdrawal and/or an orientation path for the first envelope.

9. The method according to claim 1, wherein a tendency is detected from the obtained dimensions whether the at least one predetermined dimension of the first envelope increases or decreases, wherein detecting the tendency comprises:

determining a number of successive envelopes of the plurality of envelopes for which the obtained dimensions continuously increase or decrease; and detecting the tendency when the predetermined number reaches a predetermined threshold.

10. The method according to claim 1, wherein the predetermined dimension of the first envelope comprises at least one of the following:

a width of the first envelope perpendicular to a transport direction, a length of the first envelope along the transport direction, a dimension of an envelope flap, a depth of an envelope opening, and a distance of an envelope window from an edge of an envelope body or the envelope flap.

11. The method according to claim 1, wherein measuring the first envelope during its movement further comprises obtaining a further predetermined dimension of the first envelope, and wherein adjusting the at least one unit is further based on a comparison of the obtained further dimension with a further adjusted dimension.

12. An inserting apparatus comprising at least one unit adjusted for processing envelopes according to at least one predetermined dimension of a first envelope, comprising:

a measurement path that moves a plurality of envelopes;

a sensor assembly that measures the plurality of envelopes to be transported along the measurement path, while the plurality of envelopes is moved to obtain the at least one predetermined dimension of the first envelope to provide an obtained dimension; and at least one controller that generates, depending on a comparison of the obtained dimension with an adjusted dimension and/or with one or several previously obtained dimensions, a control signal that adjusts the at least one unit of the inserting apparatus for processing the plurality of envelopes; wherein the plurality of envelopes is measured while the plurality of envelopes is fed from an envelope feeder via the measurement path to an inserting area of the inserting apparatus to insert a product into the first envelope.

* * * * *